US006062555A

United States Patent [19]

Ono et al.

[11] Patent Number: 6,062,555

[45] Date of Patent: May 16, 2000

[54] SHEET SORTER AND METHOD OF CONTROLLING THE SHEET SORTER

[75] Inventors: Takahiro Ono; Takeshi Kakinuma; Tetsunobu Shibata, all of Kyoto; Nobuyoshi Suzuki, Aichi-ken; Yasuhiro Fujimoto; Masahiro Ueda, both of Tokyo, all of Japan

[73] Assignee: Riso Kagaku Corporation, Tokyo, Japan

[21] Appl. No.: 09/061,290

[22] Filed: Apr. 17, 1998

[30] Foreign Application Priority Data

Apr. 18, 1997 [JP] Japan ..... 9-115017

[51] Int. Cl.[7] ..... B65H 33/04; B65H 39/02; B65H 39/075

[52] U.S. Cl. ..... 270/58.18; 270/58.19; 270/58.2

[58] Field of Search ..... 270/58.18, 58.19, 270/58.2; 271/287, 288, 292, 293, 294

[56] References Cited

U.S. PATENT DOCUMENTS

| | | | |
|---|---|---|---|
| 5,106,067 | 4/1992 | Higaki | 270/53 X |
| 5,106,076 | 4/1992 | Fujita et al. . | |
| 5,951,000 | 9/1999 | Sato et al. | 270/58.11 X |
| 5,992,838 | 11/1999 | Saitoh | 270/58.09 |

FOREIGN PATENT DOCUMENTS

| | | |
|---|---|---|
| 0 414 622 A2 | 2/1991 | European Pat. Off. . |
| 0 571 195 A2 | 11/1993 | European Pat. Off. . |

OTHER PUBLICATIONS

Patent Abstracts of Japan, "Movable Tray Sorter", E. Shozaburo; Publication No. 60248566, Dec. 9, 1985.

Patent Abstracts of Japan, "Sorter of Copying Machine", I. Shoichi; Publication No. 60137768, Jul. 22, 1985.

Patent Abstracts of Japan, "Sheet and the Like Classifying Device", N. Yoshiaki; Publication No. 62051564, Mar. 6, 1987.

Patent Abstracts of Japan, "Sheet Sorting Unit", H. Akimitsu; Publication No. 60019654, Jan. 31, 1985.

European Patent Application Publication No. 0 571 195 A3; Nov. 24, 1993; Bulletin 93/47.

European Patent Application Publication No. 0 414 622 A3; Feb. 27, 1991; Bulletin 91/09.

*Primary Examiner*—Christopher P. Ellis
*Assistant Examiner*—Kenneth W Bower
*Attorney, Agent, or Firm*—Nixon Peabody LLP; Donald R. Studebaker

[57] ABSTRACT

A sheet sorter includes an array of a plurality of sorting trays which are mounted on a sorter body and arranged in a vertical direction and a general-purpose tray which is mounted on the sorter body and is larger than each of the sorting trays in capacity so that it accommodates a larger number of sheets than each of the sorting trays. A tray drive mechanism provided in the sorter body moves up and down the sorting trays and the general-purpose tray so that sheets transferred by a transfer mechanism provided in the sorter body are selectively discharged onto the sorting trays or the general-purpose tray. The array of the sorting trays is positioned above the general-purpose tray. The sorting tray array and the general-purpose tray are normally held in a position where the sheet discharge port of the sheet transfer mechanism is positioned between the lowermost tray of the sorting tray array and the general-purpose tray as seen in a vertical direction.

4 Claims, 6 Drawing Sheets

SHEET SORTER AND METHOD OF CONTROLLING THE SHEET SORTER

BACKGROUND OF THE INVENTION

1. Field of the Invention

This invention relates to a sheet sorter and a method of controlling the sheet sorter, and more particularly to a sheet sorter which has a large capacity tray for receiving a large number of sheets discharged from an image forming apparatus such as a printer, a copier or the like without sorting the sheets and a plurality of sorting trays to which sheets discharged from the image forming apparatus are distributed after sorted and to a method of controlling the sheet sorter.

2. Description of the Related Art

As is well known, recent copiers are often provided with a sheet sorter mechanism. Such a copier is provided with a plurality of trays or bins which receive sheets discharged from the copier. The trays arranged in a vertical direction at suitable intervals. In some sheet sorter mechanisms, the trays are moved up and down simultaneously and in some sheet sorter mechanisms, the trays are moved up and down in sequence. In either case, a predetermined tray is brought to a sheet discharge port of the copier by the up and down movement, where the tray receives a sheet discharged through the sheet discharge port. By bringing a particular tray to the sheet discharge port according to the sort of sheet to be discharged, the sheets discharged from the copier can be sorted.

Generally the uppermost tray is used to stack sheets when the sheets need not be sorted and the sorter mechanism need not be operated. That is, when the sheets need not be sorted, all the sheets are discharged onto the uppermost tray. On the other hand, when the sheets are to be sorted, the second uppermost and the lower trays are used and are selectively brought to the sheet discharge port so that sheets are distributed to those trays by sort.

Some image forming apparatuses such as printers which output a large number of copies of the same sort are provided with a large capacity tray which accommodates one hundred or more sheets whereas said trays for sorting accommodate several tens of sheets at most.

Even for copiers, it is sometimes necessary to stack a large number of sheets on one tray and even for printers which output a large number of copies of the same sort, it is sometimes desired to sort sheets discharged therefrom.

An attempt at meeting such a requirement by enlarging the capacity of the uppermost tray in the known sorter mechanism for copiers described above will encounter the following difficulties. That is, since the sheet discharge port of the image forming apparatus must be positioned above a tray on which sheets discharged from the apparatus is to be stacked, the vertical distance between the bottom of the tray and the sheet discharge port must be much larger in the larger capacity tray, than in the sorting trays, in order to accommodate a large number of sheets. Accordingly, so long as the sheet discharge port is fixedly positioned, when the sheets are to be sorted, the maximum distance by which the trays are to be moved is determined by the sum of the height of the larger capacity tray and the height of the array of the sorting tray and becomes very large, which elongates the time necessary for moving the trays, enlarges the drive mechanism for moving up and down the trays and enlarges the overall size of the sorter.

Further when the sheets need not be sorted, the sheets are discharged onto the larger capacity tray even if the sheets are one or several in number. Since the larger capacity tray is generally provided with a high side wall in order to accommodate a large number of sheets, the high side wall interferes with taking out the sheets from the tray especially when the number of the sheets thereon is small.

Further when the sorter mechanism is to be operated, both the larger capacity tray and the sorting trays are moved up and down. Since the larger capacity tray is naturally large also in weight, a larger power is necessary to move up and down both the larger capacity tray and the sorting trays and the capacity of the drive motor must be larger.

Further when the sorter mechanism is operated, the uppermost sorting tray is first brought to the sheet discharge port and then the trays are moved upward pitch by pitch so that the lower sorting trays are brought to the sheet discharge port in sequence. Then when a predetermined number of sheets are discharged, the sorting trays and the larger capacity tray are moved downward so that the uppermost sorting tray is directly brought to the sheet discharge port. Thereafter the trays are moved upward pitch by pitch again. That is, the trays are moved intermittently overcoming the gravity. Since the drive motor requires a maximum torque when it starts rotating, to intermittently move upward the trays puts heavier load on the drive motor, which requires further larger capacity of the drive motor.

SUMMARY OF THE INVENTION

In view of the foregoing observations and description, the primary object of the present invention is to provide a sheet sorter which is provided with a plurality of sorting trays and a general-purpose tray which is larger than the sorting trays in capacity and on which sheets are stacked when the sheets need not be sorted, and in which the distance of movement of the trays by which the trays are moved during sorting may be relatively small, the drive system for moving up and the trays may be small in size, the capacity of the motor for moving up and the trays may be relatively small, the sheets discharged on the general-purpose tray can be easily taken out, and sorting of the sheets can be carried out even if an object is placed below the general-purpose tray.

Another object of the present invention is to provide a method of controlling such a sheet sorter.

In accordance with the present invention, there is provided a sheet sorter comprising an array of a plurality of sorting trays which are mounted on a sorter body and arranged in a vertical direction, a general-purpose tray which is mounted on the sorter body and is larger than each of the sorting trays in capacity so that it accommodates a larger number of sheets than each of the sorting trays and a tray drive mechanism which is provided in the sorter body and moves up and down the sorting trays and the general-purpose tray so that sheets transferred by a transfer means provided in the sorter body are selectively discharged onto the sorting trays or the general-purpose tray, wherein the improvement comprises that the array of the sorting trays is positioned above the general-purpose tray.

In the sheet sorter of the present invention with this arrangement, the array of the sorting trays and the general-purpose tray are moved up and down to bring the general-purpose tray to the sheet discharge port of the sheet transfer means when the sheets are to be discharged on the general-purpose tray and to bring the sorting trays to the sheet discharge port in sequence when the sheets are to be sorted and distributed to the sorting trays. It is natural that the tray on which a sheet is to be discharged should be positioned below the sheet discharge port. In the sheet sorter of the present invention, since the general-purpose tray is positioned below the array of the sorting trays, the sheets can be discharged on any one of the sorting trays and the general-purpose tray by moving up and down the sorting tray array and the general-purpose tray by only a distance between a position where the sheet can be discharged on the general-purpose tray and a position where the sheet can be discharged on the uppermost sheet sorting tray in the sorting tray array, i.e., the distance between the upper surface of the uppermost sorting tray and the lower surface of the lowermost sorting tray, which is equal to the height of the sorting tray array. Thus the distance of movement of the trays can be shortened as compared with when the general-purpose tray is positioned above the sorting tray array. Further since the distance of movement of the trays does not depend on the height of the general-purpose tray, the capacity of the general-purpose tray can be increased without increasing the distance of movement of the trays.

It is preferred that the general-purpose tray be removable from the sorter body. With this arrangement, for example, when the general-purpose tray need not be used, that is when the sheets are to be sorted using the sorting trays, the general-purpose tray is removed from the sorter body to lighten the load on the tray drive means and to reduce the power consumption. Further taking out the sheets stacked on the general-purpose tray is facilitated by removing the general-purpose tray from the sorter body after sheets are discharged on the general-purpose tray. That is, when the space between the general-purpose tray and the sorting tray array is small, it is hard to take out the sheets on the general-purpose tray especially when a large number of sheets are stacked on the general-purpose tray. However by removing the general-purpose tray from the sorter body, the sheets on the general-purpose tray can be easily taken out.

The sorting tray array and the general-purpose tray may be normally held in a position where the sheet discharge port of the sheet transfer means is positioned between the lowermost tray of the sorting tray array and the general-purpose tray. With this arrangement, when the sheets need not be sorted, the sheets can be discharged on the general-purpose tray without moving the trays.

The general-purpose tray may be mounted on the sorter body to be rotatable about the sorter body between a normal position where it receives sheets discharged from the sheet transfer means and a retracted position where it is swung upward about the sorter body.

This arrangement allows an object to be placed below the general-purpose tray so long as it does not push upward the general-purpose tray when the general-purpose tray is in the normal position where it receives sheets discharged from the sheet transfer means. In the normal position, the general-purpose tray may extend horizontally or may be inclined upward. When sorting is effected, the general-purpose tray is naturally moved downward below the normal position to be brought into abutment against the object. However the general-purpose tray rotates toward the retracted position, whereby further downward movement of the general-purpose tray and the sorting tray array. Since the rotation of the general-purpose tray to the retracted position gives rise to no problem since no sheet is discharged on the general-purpose tray when sorting is carried out.

It is preferred that when sorting is to be effected, the sorting tray array and the general-purpose tray be intermittently moved downward while discharging the sheets on the respective sorting trays in sequence and be moved upward, in a period when no sheet is discharged from the sheet transfer means, directly to the initial position where the sorting tray array and the general-purpose tray is positioned upon initiation of sorting.

In order to intermittently move the sorting tray array, the drive motor must be started and stopped frequently, and the drive motor requires a maximum torque when it starts rotating. That is, an intermittent movement of the sorting tray array requires more power consumption and a larger drive motor capacity than a continuous movement of the sorting tray array. By setting downward the intermittent movement of the sorting tray array, gravity of the trays can be utilized, whereby load on the drive motor can be lightened as compared with when the trays are intermittently moved upward and the capacity of the drive motor may be relatively small.

It is preferred that the trays be moved upward at a speed lower than the speed at which the trays are moved downward. That is, since the gravity of the trays assists the drive motor in moving downward the trays, downward movement of the trays at high speed does not require so large capacity of the drive motor whereas upward movement of the trays at high speed requires a larger capacity of the drive motor since the drive motor must lift the trays against the gravity thereof. Accordingly by moving upward the trays at low speed, the capacity of the drive motor may be relatively small. Thus, by moving the trays upward at a speed lower than the speed at which the trays are moved downward, sorting can be effected at a higher speed without increasing the capacity of the drive motor.

DESCRIPTION OF THE PREFERRED EMBODIMENT

Figure 1:
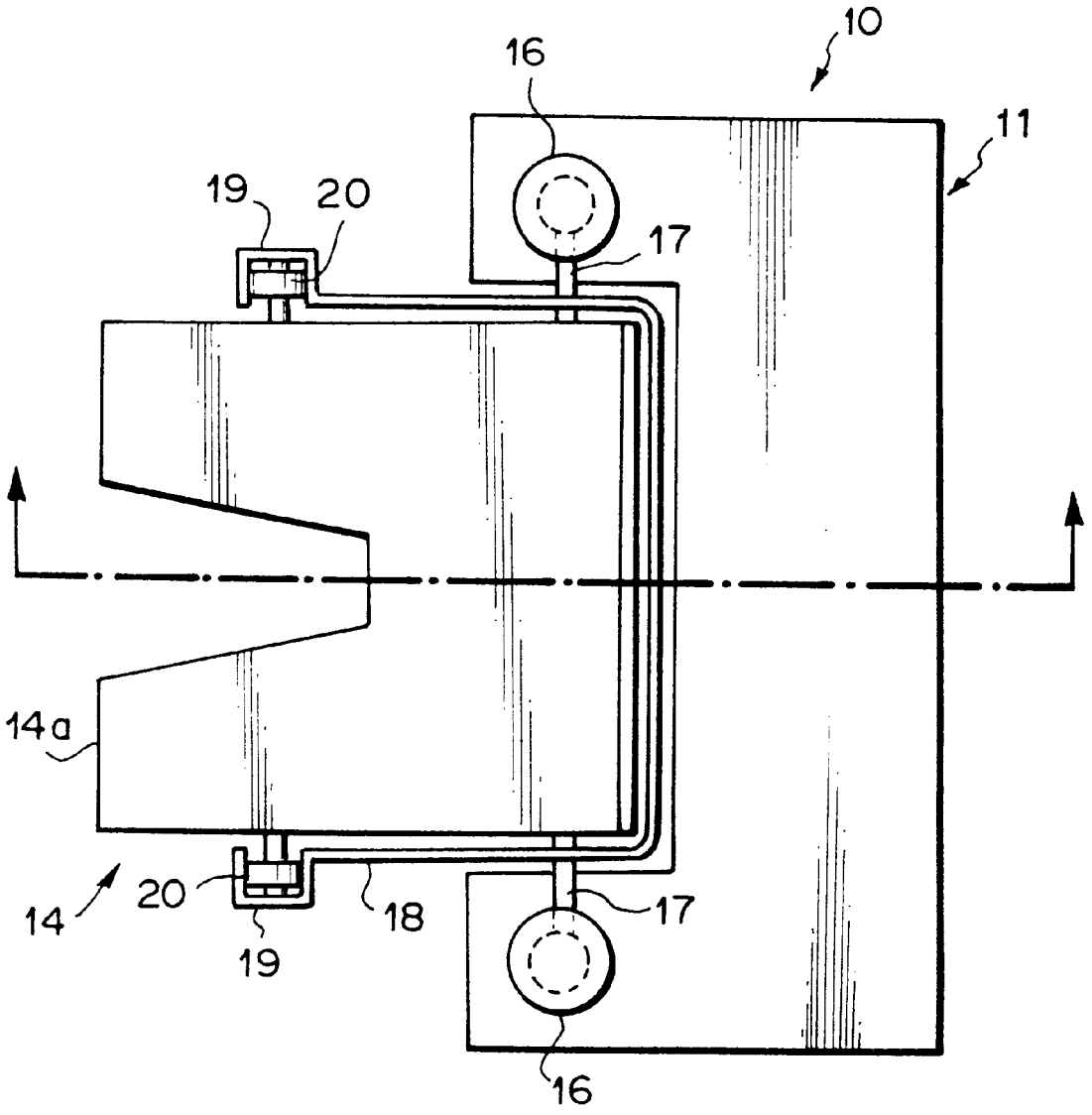
FIG. 1 is a plan view of a sheet sorter in accordance with a first embodiment of the present invention.

A sheet sorter 10 in accordance with a first embodiment of the present invention includes a sheet transfer mechanism 12 disposed in a sorter body 11, which is substantially rectangular, at the middle thereof in the vertical direction. The sheet transfer mechanism 12 comprises upper and lower conveyor rollers 12*a* which form a sheet discharge port. An image forming apparatus (not shown) such as a copier, printer or the like is connected to the sorter body 11 so that sheets discharged from the image forming apparatus are delivered to the sheet transfer mechanism 12. The conveyor rollers 12*a* discharge the sheets delivered from the image forming apparatus on a tray just below the sheet discharge port.

A sorting tray array 14 and a general-purpose tray 15 are disposed on the side of the sorter body 11 where the sheet discharge port opens with the general-purpose tray 15 positioned below the sorting tray array 14.

Figure 2:
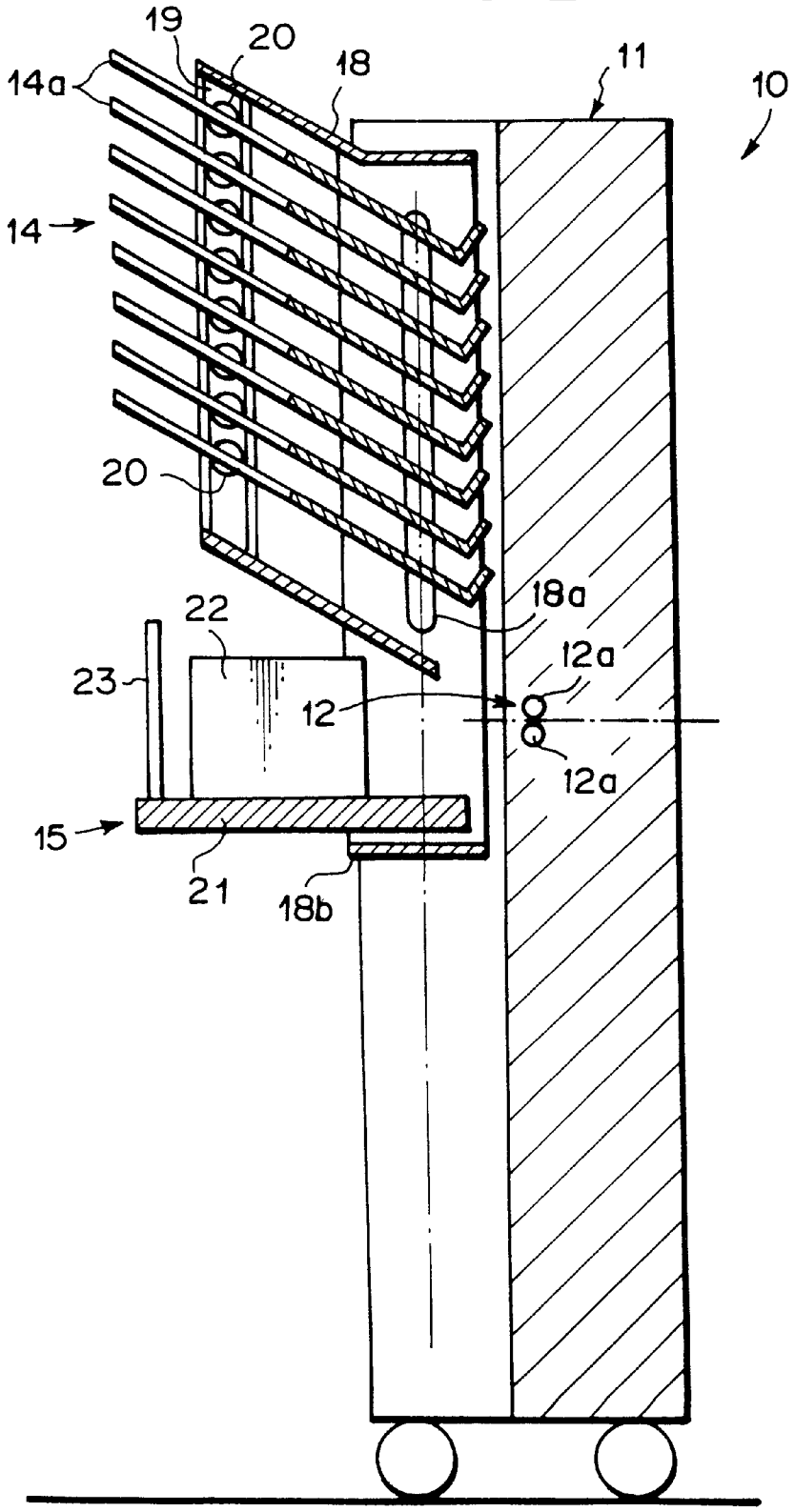
FIG. 2 is a side view of the sheet sorter where the trays are held in the home position.
Figure 3:
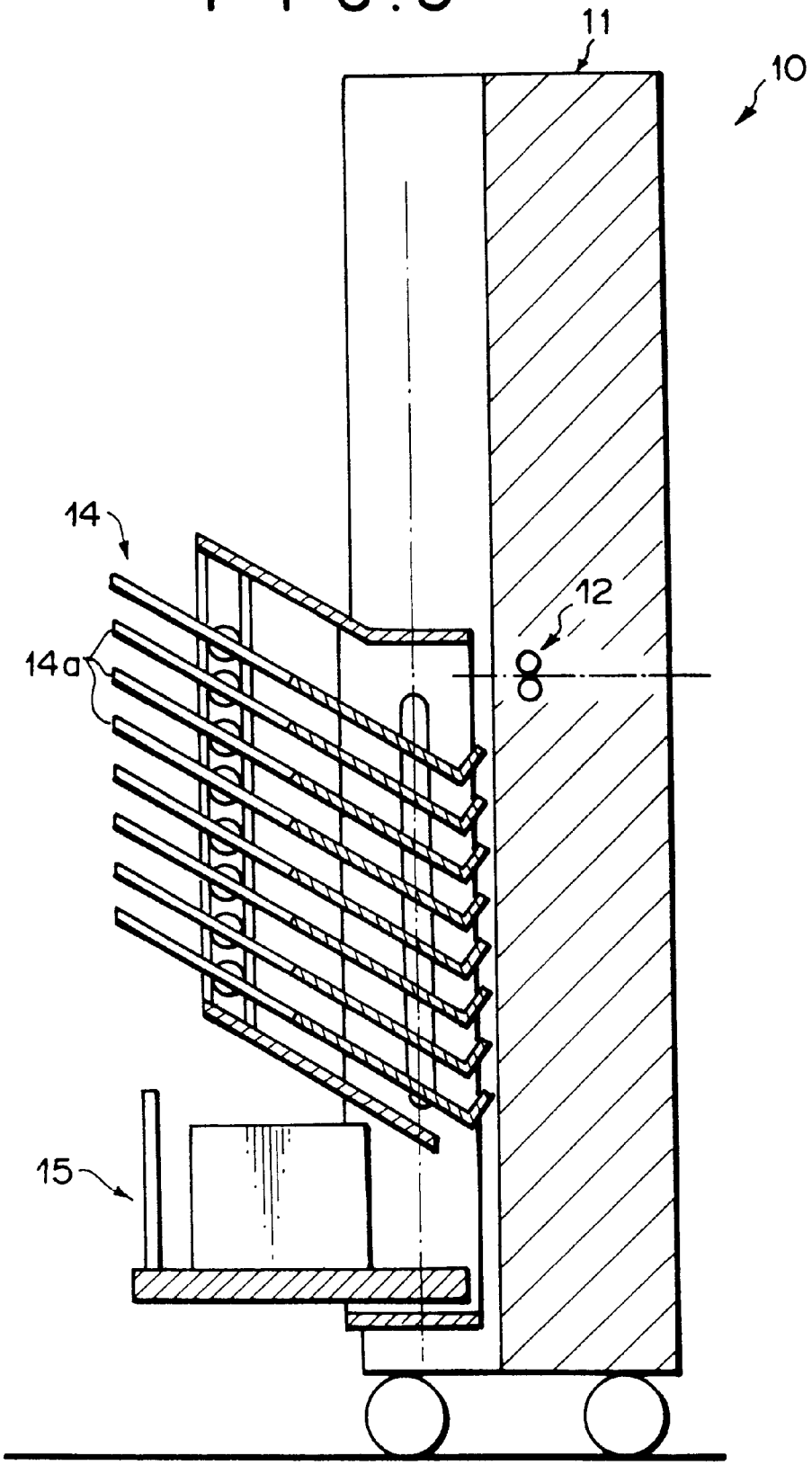
FIG. 3 is a side view of the sheet sorter where the trays are in the lowermost position.

The sorting tray array 14 comprises a plurality of sorting trays 14*a* which are arranged in a vertical direction at predetermined intervals. Each sorting tray 14*a* is obliquely mounted on the sorter body 11 with its base end positioned lower than its free end as shown in FIGS. 2 and 3.

A cam rod 16 in the form of a rod provided with a helical channel of a predetermined width extends vertically in the sorter body 11 on each side of the base ends of the sorting trays 14*a*. Each sorting tray 14*a* is provided with a cam follower 17 on each side of the base end portion thereof and the cam follower 17 is in mesh with the helical channel of the corresponding cam rod 16. The cam rods 16 are rotated in synchronization with each other by a drive mechanism (not shown) provided in the sorter body 11. When the cam rods 16 are rotated in one direction, the sorting trays 14*a* are moved up or down by a distance corresponding to the lead of the helical channel of cam rods 16. Though not shown, the lead of each cam rod 16 is larger in the middle part thereof opposed to the sheet discharge port than the rest part so that the intervals between the trays 14*a* are enlarged at the middle part. The drive mechanisms for the cam rods 16 and for the conveyor rollers 12*a* are connected to a control section (not shown) of the sheet sorter 10 comprising a CPU, RAM, ROM, input/output port and the like. The control section is connected by radio or through a signal line to a control section (not shown) of the image forming apparatus connected to the sheet sorter 10.

A slide frame 18 extends along opposite sides of the sorting trays 14*a* and is engaged with the cam rods 16 through cam followers (not shown) similar to those for the sorting trays 14*a*. Accordingly the sorting tray array 14 and the slide frame 18 are translated up or down integrally with each other in response to rotation of the cam rods 16. Each cam follower 17 extends outward through a slit 18*a* formed in the slide frame 18 and is in mesh with the helical channel of the cam rod 16.

A vertical guide 19 is formed in the slide frame 18 at a portion opposed to the free end portions of the sorting trays 14*a* on each side of the sorting tray array 14 and an engagement piece 20 on each side of each sorting tray 14*a* is in engagement with the vertical guide 19. The vertical guide 19 is in the form of a vertical recess and the engagement piece 20 is roller received in the recess. The distance between the cam follower 17 and the engagement piece 20 is fixed, the vertical guide 19 and the cam rod 16 extend in parallel to each other and the distance between the vertical guide 19 and the cam rod 16 is smaller than the distance between the cam follower 17 and the engagement piece 20. Accordingly each sorting tray 14*a* is inclined at an angle which depends upon the difference between the distance between the vertical guide 19 and the cam rod 16 and the distance between the cam follower 17 and the engagement piece 20. Since those distances are fixed, the sorting trays 14*a* are moved up and down substantially in parallel to each other. When a sorting tray 14*a* is moved upward by a larger distance at the middle of the cam rods 16 so that the space between the base end portion thereof and that of the sorting tray 14*a* just below is enlarged, the space between the free end portion of the sorting trays is also enlarged since the distances between the cam follower 17 and the engagement piece 20 in the two sorting trays 14*a* are the same and fixed. Accordingly there is no fear that the space between the free end portions of the sorting trays 14*a* is narrowed and the number of sheets which can be stacked on the lower sorting tray 14*a* is reduced.

Further in this particular embodiment, since the slide frame 18 and the sorting trays 14*a* are engaged with the same cam rod 16, they are moved up and down by the same distance in synchronization with each other. That is, the sorting trays 14*a* and the slide frame 18 are not moved relative to each other, and the engagement piece 20 on each sorting tray 14*a* and the vertical guide 10 are not moved relative to each other. Accordingly no noise is generated upon their movements and resistance against their movements is very small. The engagement piece 20 is moved relative to the vertical guide 19 only when the can followers 17 of the sorting tray 14*a* pass the middle of the cam rods 16 and the sorting tray 14*a* is moved by a larger distance.

The general-purpose tray 15 is provided with a pair of side guides 22 on opposite sides of a bottom plate 21 and an end guide 23 on the free end of the bottom plate 21, whereby capacity of the general-purpose tray 15 is enlarged. The guides 22 and 23 make it feasible to stack a larger number of sheets in a stably aligned state. When a sheet is discharged on the general-purpose tray 15, the sheet smoothly falls onto the bottom of the general-purpose tray 15 or on the preceding sheet(s) thereon under the guidance of the guides 22 and 23 though the sheet falls a distance larger than that in the sorting trays 14*a*.

The general-purpose tray 15 having a larger capacity is mounted on the bottom wall 18*b* of the slide frame 18 so that the general-purpose tray 15 is moved up and down together with the slide frame 18 and the sorting tray array 14. By moving up and down the sorting tray array 14 and the general-purpose tray 15 to bring a selected one of them to the sheet discharge port, the sheet discharged through the sheet discharge port is discharged onto the selected tray.

Figure 4:
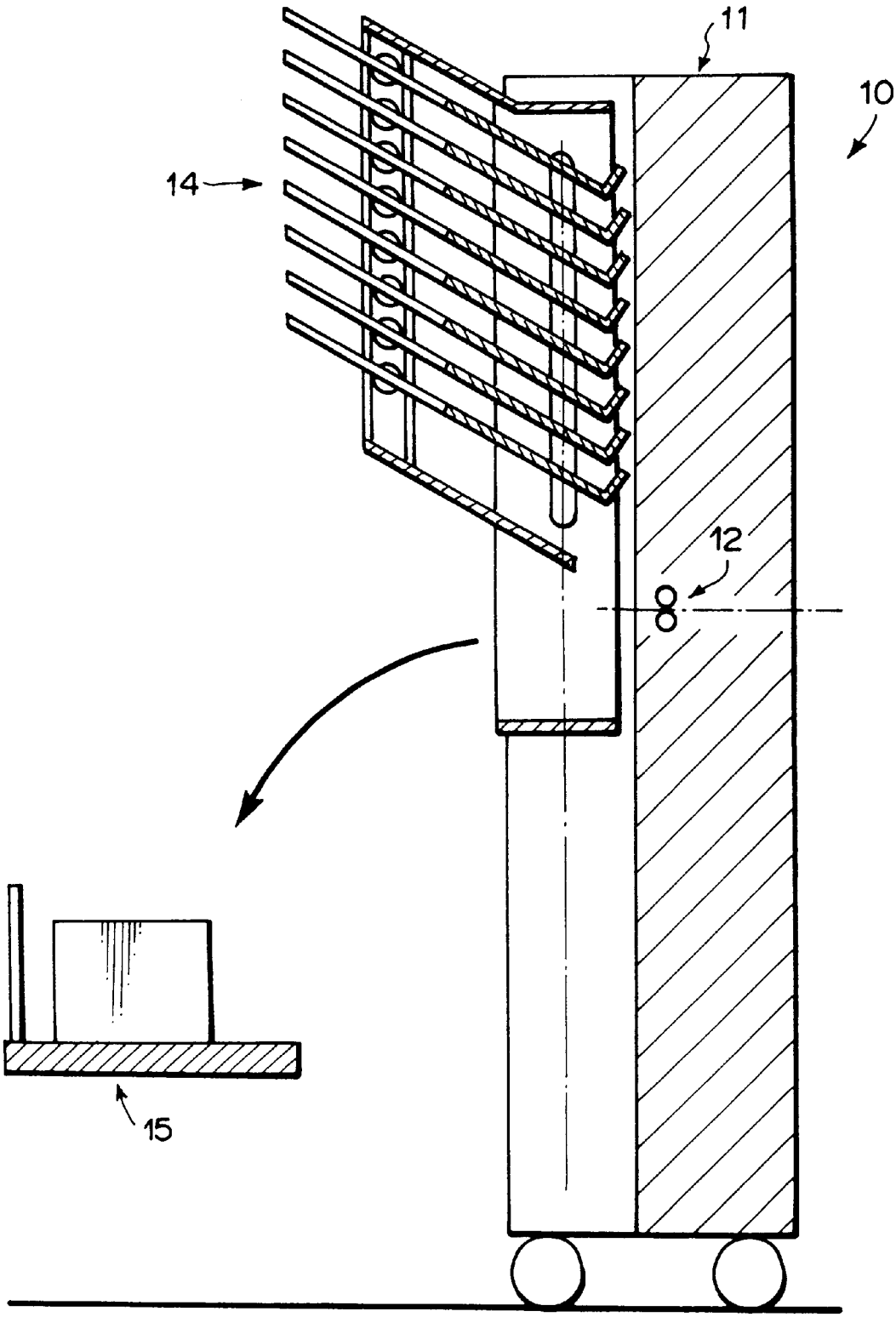
FIG. 4 is a side view of the sheet sorter with the general-purpose tray removed from the sorter body.

The general-purpose tray 15 is mounted on the slide frame 18 to be removable therefrom by a known mechanism. By removing the general-purpose tray 15 from the slide frame 18 as shown in FIG. 4 when the sorting tray array 14 is to be moved up and down to sort the sheets discharged through sheet discharge port, load on the tray drive mechanism can be lightened.

Further in this particular embodiment, in the home position where the sorting tray array 14 and the general-purpose tray 15 are normally held, the sheet discharge port defined by the conveyor rollers 12*a* is positioned below the sorting tray array 14 and above the general-purpose tray 15 as shown in FIG. 2. The sorting tray array 14 and the general-purpose tray 15 are returned to the home position after a series of sorting operation is completed. When a sheet is discharged with the trays held in the home position, the sheet falls on the general-purpose tray 15.

When sorting is to be effected, the sorting tray array 14 and the general-purpose tray 15 (or without the general-purpose tray 15) are intermittently moved downward and the sorting trays 14*a* are brought to the sheet discharge port in sequence from the lowermost one and one sheet is discharged on the sorting tray 14*a* opposed to the sheet discharge port while the trays are stopped. After a sereis of sheets are discharged, the sorting tray array 14 and the general-purpose tray 15 are moved upward directly to a position where the lowermost sorting tray 14*a* is opposed to the sheet discharge port. The trays are moved upward at a speed lower than the speed at which they are moved downward. When the trays are moved downward, gravity of the trays assists the drive mechanism and accordingly the trays are moved at a high speed to conform to a high speed discharge of sheets. On the other hand, when the trays are moved upward, the drive mechanism must lift the trays overcoming gravity of the trays, and accordingly, load on the drive mechanism is lightened by moving upward the trays at a lower speed. Further since the trays are moved continuously when moved upward, torque required to move upward the trays may be relatively small.

Operation of the sheet sorter of this embodiment will be described hereinbelow. When sheets are to be discharged on the general-purpose tray 15, the trays are held in the home position shown in FIG. 2. In the home position, the sorting tray array 14 are positioned above the sheet discharge port defined by the conveyor rollers 12*a* and only the general-purpose tray 15 is positioned below the sheet discharge port. Accordingly the sheets discharged through the sheet discharge port fall on the general-purpose tray 15 and are stacked thereon. In this particular embodiment, the general-purpose tray 15 is used when the sheets need not be sorted irrespective of the number of the sheets discharged.

When the sheets are to be sorted, the cam rods 16 are intermittently rotated in a predetermined direction, thereby intermittently moving downward the sorting trays 14*a* and the slide frame 18. In response to downward movement of the slide frame 18, the general-purpose tray 15 is moved downward.

As can be seen from FIGS. 2 and 3, the distance by which the trays are to be moved from the state shown in FIG. 2 in order to bring all the sorting trays 14*a* from the lowermost one to the uppermost one to the sheet discharge port is substantially equal to the height of the sorting tray array 14 in this embodiment, which is smaller than when the general-purpose tray 15 is positioned above the sorting tray array 14, where the relevant distance is equal to the sum of the height of the sorting tray array 14 and the height of the general-purpose tray 15. Further since the distance by which the trays are to be moved from the state shown in FIG. 2 in order to bring all the sorting trays 14*a* to the sheet discharge port does not depends upon the height of the general-purpose tray 15 in this embodiment, the difference in the relevant distance between the sheet sorter of this embodiment where the general-purpose tray 15 is below the sorting tray array 14 and a sheet sorter where the former is positioned above the latter increases as the height of the general-purpose tray is increased in order to increase the capacity of the general-purpose tray.

By normally holding the trays in the home position shown in FIG. 2, the sheets can be discharged on the general-purpose tray 15 without moving the trays, which shortens the time required to handling the sheets when the sheets need not be sorted, load on the drive mechanism and power consumption are nullified and noise generated in response to movement of the trays can be suppressed.

Further when sorting is to be performed, by bringing the sorting trays 14*a* in the sorting tray array 14 to the sheet discharge port in sequence from the lowermost one, returning the sorting tray array 14 to the position where the lowermost sorting trays 14*a* is positioned opposed to the sheet discharge port after a predetermined number of sheets are discharged, and then bringing the sorting trays 14*a* in the sorting tray array 14 to the sheet discharge port in sequence from the lowermost one again, each sorting tray 14*a* receives sheets at regular intervals. Accordingly the dryness of ink on the preceding sheet by the time the next sheet is discharged on each sorting tray 14*a* becomes constant, which contributes to preventing the next sheet from discharging on the preceding sheet before ink dries and staining the surface of the preceding sheet. Further since sorting is effected while moving downward the trays, the driving force can be small and accordingly a relatively small drive motor can be used and high speed sorting can be realized. Further since the sorting tray array 14 may be returned to the position of initiation of sorting by the time the ink dries (e.g., in ten and several seconds), the sorting tray array 14 may be slowly moved upward, which reduces the driving force.

The control of the trays described above is only an example, and the home position, the order in which the sorting trays 14*a* are brought to the sheet discharge port and the like may be freely varied.

Since the general-purpose tray 15 is removable in this embodiment, the general-purpose tray 15 may be removed from the sorter body 11 when sorting is to be performed. When sorting is to be performed, the general-purpose tray 15 is not used and at the same time the general-purpose tray 15 which is larger in weight increases load on the drive mechanism in vain. Accordingly it is preferred that the general-purpose tray 15 be removed when sorting is to be performed so that only the sorting tray array 14 is moved up and down and load on the drive mechanism is lightened.

Further by removing the general-purpose tray 15 from the sorter body 11 when taking out the sheets discharged on the general-purpose tray 15, the sheets can be taken out easily. That is, on the sorter body 11, the sorting tray array 14 is positioned above the general-purpose tray 15 and interferes with taking out the sheets on the general-purpose tray 15 together with the guides 22 and 23 of the general-purpose tray 15 especially when the space between the general-purpose tray 15 and the sorting tray array 15 is narrow and a large number of sheets are on the general-purpose tray 15.

Sorting may be controlled as follows. For example, when the sheets are to be sorted into a number larger than the number of the sorting trays 14*a* in the sorting tray array 14 (though such a request may be inhibited), the sheet sorter may be controlled to discharge all the sheets which cannot be allocated to any of the sorting trays 14*a* of the sorting tray array 14 on the general-purpose tray 15. That is, in the illustrated case, the number of sorting trays 14*a* is eight. When the sheets are to be sorted into ten in this case, two sheets cannot be allocated to any one of the sorting trays 14*a*. In such a case, the two sheets may be discharged on the general-purpose tray 15. More specifically, for example, first and second sheets are discharged on the general-purpose tray 15 with the trays held in the home position and third to tenth sheets are discharged on the sorting trays 14*a* in sequence from the lowermost one to the uppermost one while intermittently lowering the sorting tray array 14.

Further when the sheets are to be sorted into a number smaller than the number of the sorting trays 14*a* in the sorting tray array 14, the sheets need not be discharged on the sorting trays in sequence from the lowermost one but may be discharged on the sorting trays 14*a* in sequence from the sorting tray 14*a* which is (the number of sorting trays 14*a* minus the number into which the sheets are to be sorted)-th as numbered from the lowermost one. With this arrangement, the sheets can be stacked only on the upper sorting trays 14*a* including the uppermost one, which facilitates taking out the sheets from trays 14*a*.

Figure 5:
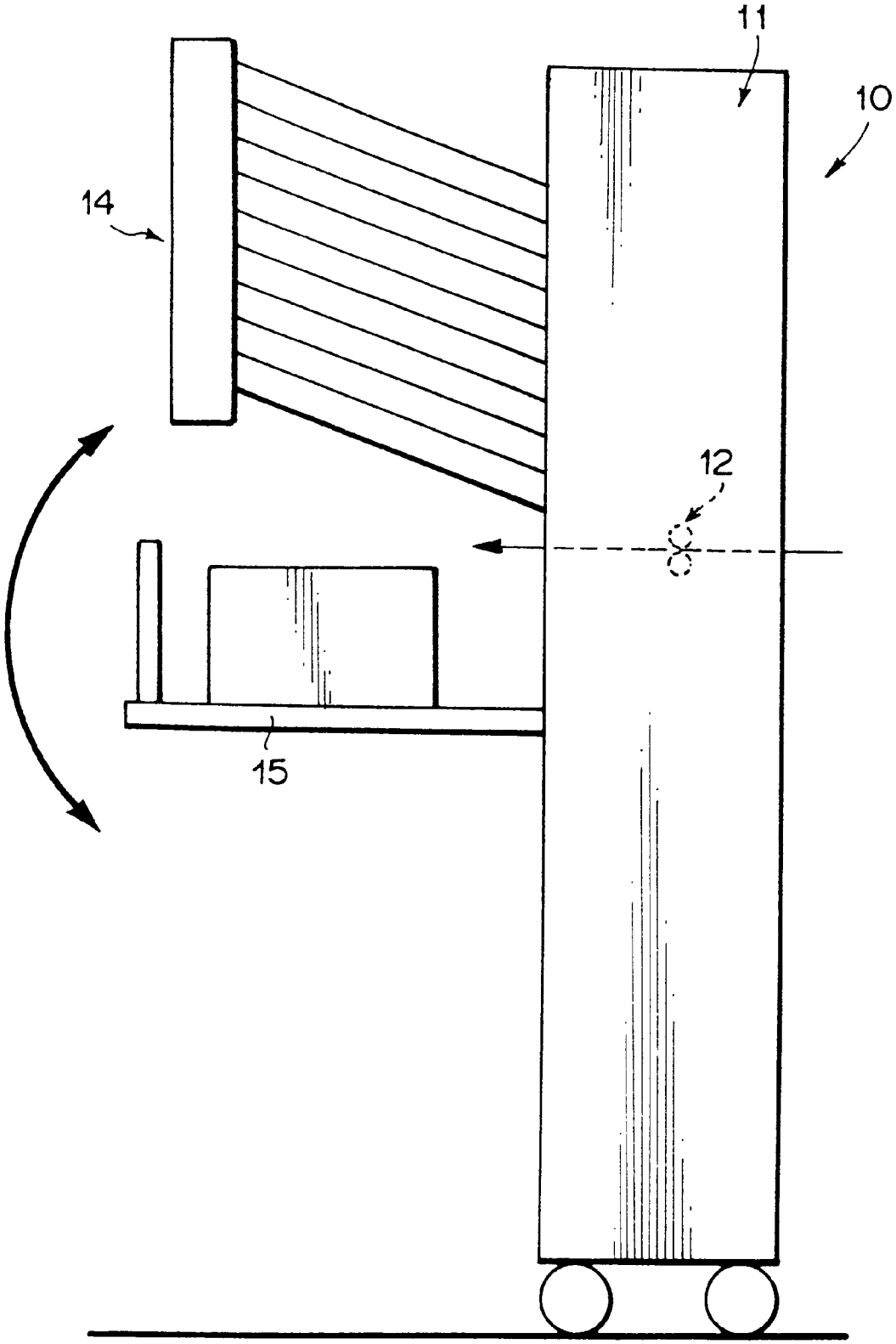
FIG. 5 is a side view of a sheet sorter in accordance with a second embodiment of the present invention where the trays are in the home position.
Figure 6:
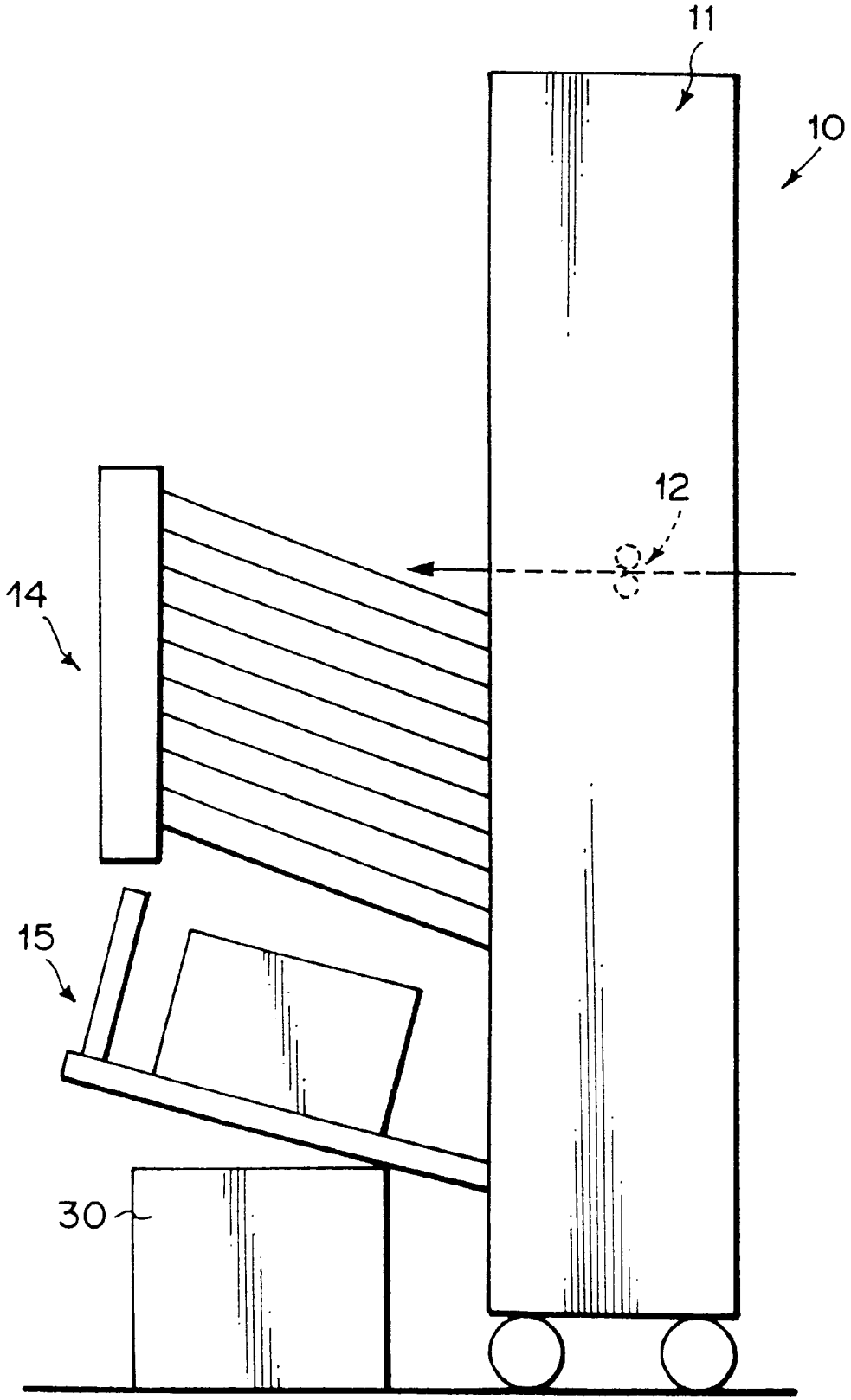
FIG. 6 is a side view of the sheet sorter where the trays are moved downward from the home position.

FIGS. 5 and 6 show a sheet sorter 10 in accordance with a second embodiment of the present invention. The sheet sorter of this embodiment is substantially the same as that of the preceding embodiment except that the general-purpose tray 15 is mounted on the bottom 18*b* of the slide frame 18 for rotation about is base end. That is, the general-purpose tray 15 is normally held horizontally as shown in FIG. 5 and is rotatable upward about the base end thereof by a predetermined angle. With this arrangement, when the sorting tray array 14 and the general-purpose tray 15 are moved downward from the home position and the general-purpose tray 15 abuts against an object 30 below during sorting, the general-purpose tray 15 can rotate upward to permit further downward movement of the sorting tray array 14, whereby sorting can be continued without interfered with by the object 30.

What is claimed is:

1. A sheet sorter comprising an array of a plurality of sorting trays which are mounted on a sorter body and arranged in a vertical direction, a general-purpose tray which is mounted on the sorter body and a tray drive mechanism which is provided in the sorter body and moves up and down the sorting trays and the general-purpose tray so that sheets transferred by a sheet transfer means provided in the sorter body are selectively discharged onto the sorting trays or the general-purpose tray, wherein the improvement comprises that the array of the sorting trays is positioned above the general-purpose tray.

2. A sheet sorter as defined in claim 1 in which the sorting tray array and the general-purpose tray are normally held in a position where the sheet discharge port of the sheet transfer means is positioned between the lowermost tray of the sorting tray array and the general-purpose tray as seen in a vertical direction.

3. A sheet sorter as defined in claim 1 in which said general-purpose tray is removably mounted on the sorter body.

4. A sheet sorter as defined in claim 1 in which said general-purpose tray is mounted on the sorter body so that it can rotate about the sorter body between a normal position where it receives sheet discharged from the sheet transfer means and a retracted position angularly spaced upward from the normal position.

* * * * *